US007617552B2

(12) United States Patent
Strickland

(10) Patent No.: US 7,617,552 B2
(45) Date of Patent: Nov. 17, 2009

(54) EXPANDABLE FRAMES FOR LIFTING BED COVERS

(75) Inventor: Carey D. Strickland, Jefferson, GA (US)

(73) Assignee: Cover Hover, LLP., Jefferson, GA (US)

( * ) Notice: Subject to any disclaimer, the term of this patent is extended or adjusted under 35 U.S.C. 154(b) by 0 days.

(21) Appl. No.: 12/405,290

(22) Filed: Mar. 17, 2009

(65) Prior Publication Data

US 2009/0235455 A1 Sep. 24, 2009

Related U.S. Application Data

(60) Provisional application No. 61/037,722, filed on Mar. 19, 2008.

(51) Int. Cl.
*A47C 21/02* (2006.01)

(52) U.S. Cl. ..... 5/505.1

(58) Field of Classification Search ..... 5/505.1, 5/506.1, 504.1
See application file for complete search history.

(56) References Cited

U.S. PATENT DOCUMENTS 2,602,171 A * 7/1952 Good ..... 5/505.1
2,676,340 A * 4/1954 Garriott et al. ..... 5/505.1
3,680,158 A * 8/1972 Speed ..... 5/505.1
5,329,658 A 7/1994 Fontenot
5,881,406 A 3/1999 Cobb
6,240,581 B1 6/2001 Pender
6,834,403 B1 12/2004 Elliott
6,901,616 B1 6/2005 Warrington
7,137,159 B1 11/2006 Choate
7,231,680 B1 6/2007 Hafford
7,281,282 B2 10/2007 Huber
2008/0295247 A1* 12/2008 Rogers ..... 5/505.1

* cited by examiner

*Primary Examiner*—Alexander Grosz
(74) *Attorney, Agent, or Firm*—Thomas, Kayden, Horstemeyer & Risley, LLP.

(57) ABSTRACT

Expandable frames for lifting bed covers are provided. A representative frame includes: a movable frame segment; and a support frame segment operative to attach the support frame segment to a bed and support the movable frame segment; the movable frame segment being movable with respect to the support frame segment between a contracted position, which corresponds to lowering of bed covers draped across the movable frame segment, and an expanded position, which corresponds to raising of the bed covers.

5 Claims, 6 Drawing Sheets

EXPANDABLE FRAMES FOR LIFTING BED COVERS

CROSS REFERENCE TO RELATED APPLICATION

This utility application claims the benefit of and priority to U.S. Provisional Patent Application 61/037,722, filed on Mar. 19, 2008, which is incorporated by reference herein in its entirety.

BACKGROUND

1. Technical Field

The invention concerns devices for lifting bed covers at the foot of a bed.

2. Description of the Related Art

Devices for lifting bed covers are known. These devices typically are used in order to prevent bed covers from putting pressure on a person's feet while under the covers. This can be desirable for a number of reasons, such as when a person is afflicted with a condition that causes pain when pressure is exerted on the feet.

While meeting with varying degrees of success, many prior art devices for lifting bed covers are complex and rather expensive.

SUMMARY

Expandable frames for lifting bed covers are provided. In this regard, an exemplary embodiment of an expandable frame comprises: a movable frame segment having a cross bar, a first distal end and a second distal end; and a support frame segment operative to attach the support frame segment to a bed and support the movable frame segment, the support frame segment having a first passage and a second passage, the first passage being operative to receive the first distal end, the second passage being operative to receive the second distal end; the movable frame segment being movable with respect to the support frame segment between a contracted position, which corresponds to lowering of bed covers draped across the movable frame segment, and an expanded position, which corresponds to raising of the bed covers; in the contracted position, the first distal end extending through the first passage and the second distal end extending through the second passage such that the support frame segment is positioned between the cross bar of the movable frame segment and the distal ends of the movable frame segment.

Another exemplary embodiment of an expandable frame for lifting bed covers comprises: a first upright; a second upright; an upper cross bar; a lower cross bar oriented substantially parallel with respect to the upper cross bar; a first connector having a first opening and a second opening, the first opening receiving an upper end of the first upright, the second opening receiving a first end of the upper cross bar; a second connector having a first opening and a second opening, the first opening of the second connector receiving an upper end of the second upright, the second opening of the second connector receiving a second end of the upper cross bar; a first leg; a second leg; a third connector having a first opening, a second opening, a third opening and a fourth opening, the first opening of the third connector receiving a lower end of the first upright, the second opening of the third connector receiving a first end of the lower cross bar, and the third opening of the third connector receiving an attached end of the first leg such that a free end of the first leg extends outwardly from the third connector; and a fourth connector having a first opening, a second opening, a third opening and a fourth opening, the first opening of the fourth connector receiving a lower end of the second upright, the second opening of the fourth connector receiving a second end of the lower cross bar, and the third opening of the fourth connector receiving an attached end of the second leg such that a free end of the second leg extends outwardly from the fourth connector; the first upright being movable with respect to the third connector and the second upright being movable with respect to the fourth connector such that, in a contracted position, the upper cross bar is spaced from the lower cross bar at a first distance and, in an expanded position, the upper cross bar is positioned farther than the first distance from the lower cross bar to lift bed covers draped over the upper cross bar away from the lower cross bar.

Other devices, systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Figure 1:
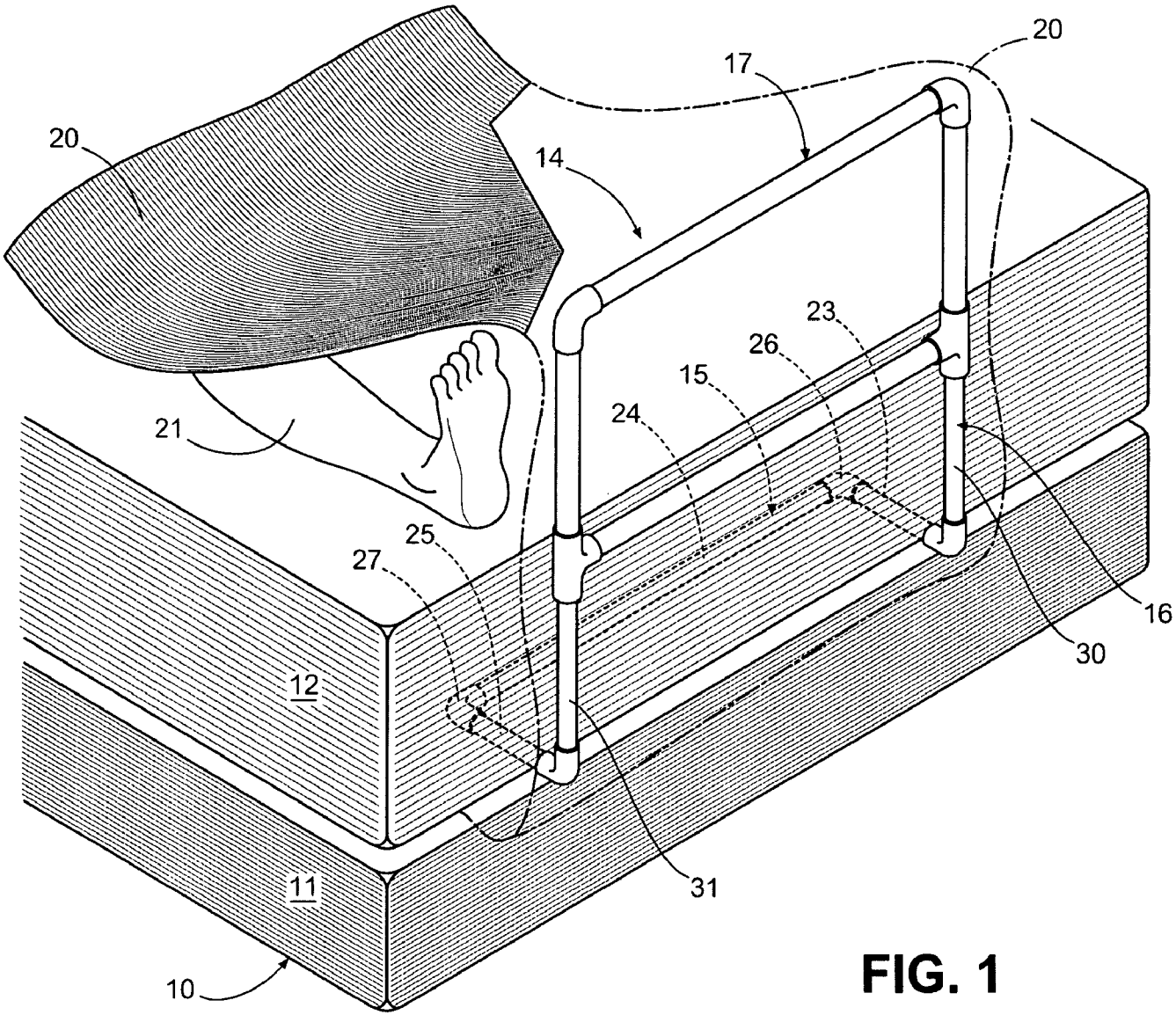
FIG. 1 is a perspective view of the foot of a bed, including the springs, the mattress, and an exemplary embodiment of an expandable frame for lifting bed covers mounted to the bed, showing how the device lifts the bed covers at the foot of the bed over the feet of the person lying in the bed.

FIG. 1 shows the foot of a bed 10, including box springs 11 and a mattress 12 overlying the box springs. An exemplary embodiment of an expandable frame for lifting bed covers 14 is mounted to the foot of the bed by inserting the lateral support frame segment 15 between the box springs and the mattress, and the vertical support frame segment 16 extending upwardly from the lateral support frame segment, and the movable support frame segment 17 extending to a height higher than the upper surface of the mattress 12. The bed covers 20 would be draped over the expandable support frame 14 and over the feet of the person 21 lying on the bed. When in its expanded position, the expandable frame forms a tent-like shape in the bed covers 20, with the tent shape extending over the feet of the person.

Figure 2:
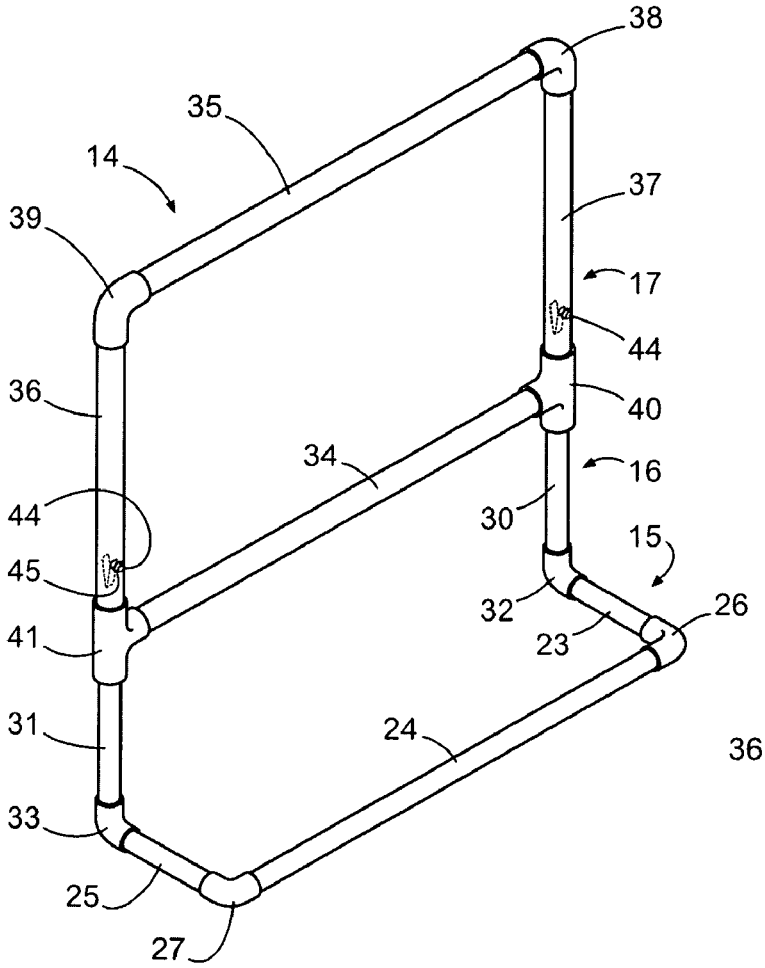
FIG. 2 is a perspective view of an exemplary embodiment of an expandable frame, showing the frame in its expanded configuration.

FIG. 2 shows the expandable frame 14 in more detail. The lateral support frame segment 15 is approximately U-shaped, including rectilinear bars 23, 24 and 25 connected at their ends to form the U shape by elbow connectors 26 and 27. The U-shape formed by the rectilinear bars and the elbow connectors are to extend beneath the mattress 12, over the box springs 11 at the foot of the bed. The weight of the mattress holds the expandable frame 14 in place.

Vertical support frame 16 comprises upright rectilinear bars 30 and 31 joined by elbows 32 and 33 to the bars 23 and 25 of the lateral support frame segment.

Movable support frame segment 17 is rectangular and includes opposed lower and upper lateral bars 34 and 35 and opposed vertical end bars 36 and 37. Elbow joints 38 and 39 connect the ends of the upper lateral bar 34 to the upper ends of the opposed vertical end bars 36 and 37. T-connectors 40 and 41 join the lower ends of the opposed vertical end bars 36 and 37 to the ends of the lower lateral bar 34.

The upright bars 30 and 31 of the vertical support frame segment 16 and the opposed vertical end bars 36 and 37 of the movable support frame segment 17 are tubular, with the outside diameter of the upright bars 30 and 31 being smaller than the inside diameter of the opposed vertical end bars 36 and 37, and smaller than the openings through the T connectors 40 and 41. With this arrangement, the T connectors 40 and 41 and the opposed vertical bars 36 and 37 are telescopically movable about the smaller upright bars 30 and 31, so that the movable support frame segment 17, including its lower lateral bar and the elbow connectors, are movable along the lengths of the upright bars 30 and 31 of the vertical support frame segment 16. This allows the movable support frame segment 17 to be moved up and down with respect to the lateral support frame segment 15.

Figure 3A:
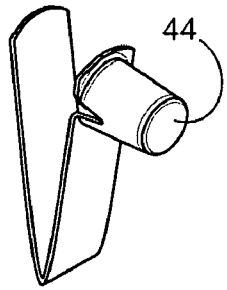
FIG. 3A is a perspective view of a lock button of the type that is used to lock the telescopic portions of an exemplary embodiment of an expandable frame in a fixed position.
Figure 3B:
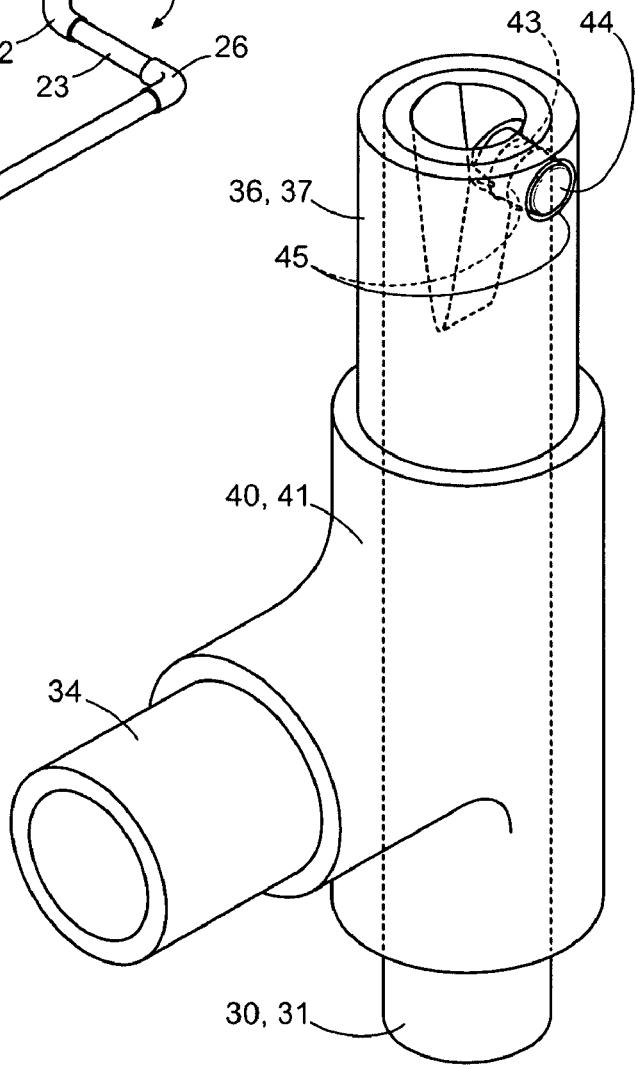
FIG. 3B is a perspective view of a telescopic section of an exemplary embodiment of an expandable frame, showing the lock button in place in the inner tube, for expansion into the opening of the outer tube, with the outer tube broken open to show the lock button.

When the expandable frame 14 is expanded as shown in FIG. 2, only the upper ends of the upright bars 30 and 31 of the vertical support frame segment 16 remain extended upwardly through the T connectors 40 and 41 and about two inches into the lower ends of the opposed vertical end bars 36 and 37 of the movable support frame segment 17. The spring lock buttons 44 of the type show in FIG. 3A are positioned in the upper end portions of the smaller diameter of the upright bars 30 and 31, with the lock buttons 44 in registration with an opening 43 through the upper portion of each of the upright bars 30 and 31. The opposed vertical end bars 36 and 37 have openings 45 there through just above the T connectors 40 and 41 that will register with the lock buttons 44. With this arrangement, when the movable support frame segment 17 is lifted to its up position, the lock button registers with the opening, such as opening 45, holding the movable support frame segment 17 in its upward position, as shown in FIGS. 1 and 2.

Figure 4:
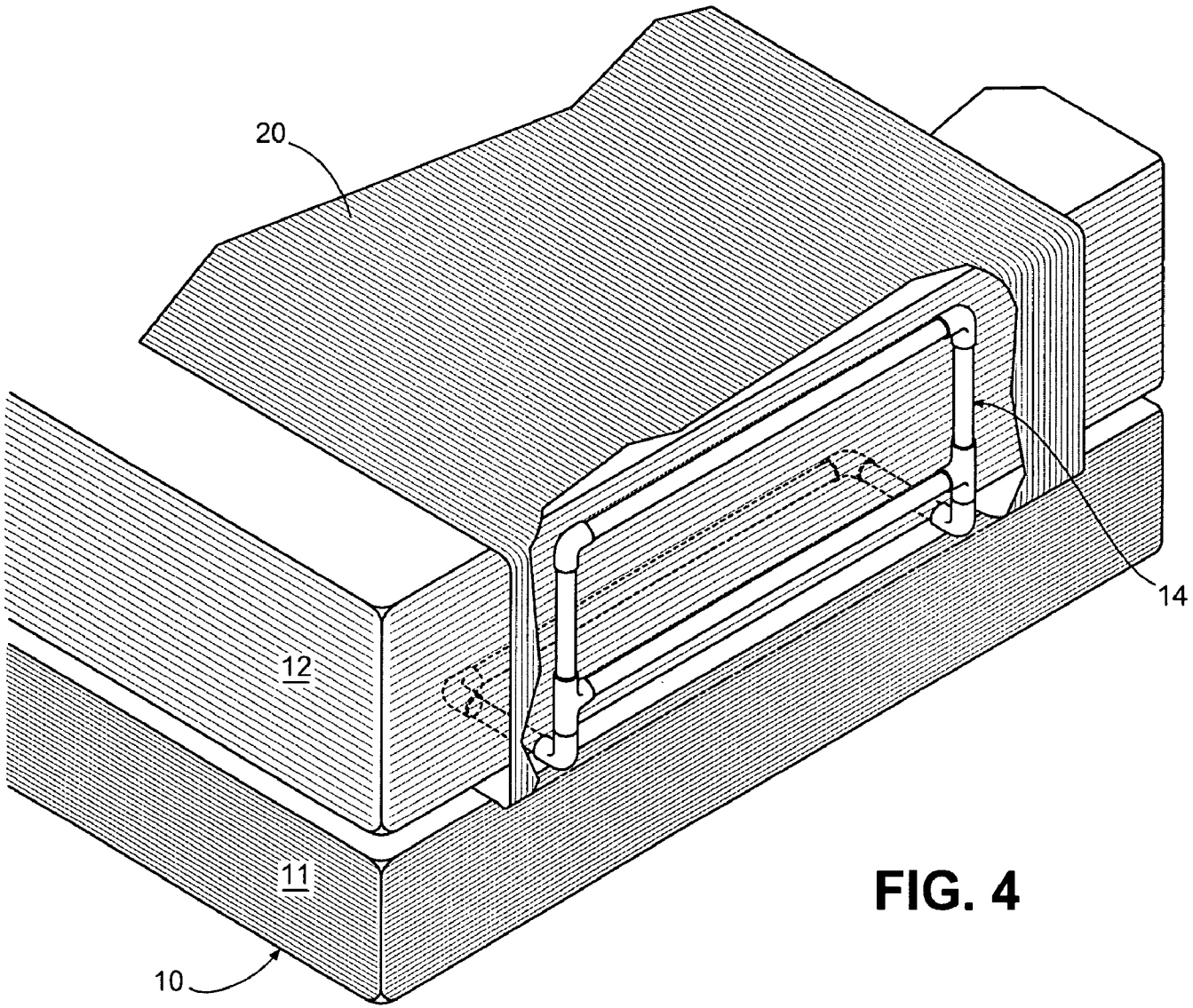
FIG. 4 is a perspective view of the expandable frame of FIG. 1, but showing the frame in its contracted position.

FIG. 1 shows the expandable frame in its expanded position with the covers lifted from the feet of the person 21. When the expandable frame is to be contracted, by pressing the lock buttons 44 inwardly, this unlocks the movable support frame segment 17 from the vertical support frame segment 16, allowing the movable support frame segment 17 to move downwardly and telescopically about the smaller upright bars 30 and 31 of the vertical support frame segment 16. As shown in FIG. 4, this lowers the movable support frame segment 17 so that it does not protrude above the plane of the top surface of the mattress 12. The bed covers 20 then lie flat on the surface of the mattress, with the expandable frame 14 substantially hidden from view.

Figure 5:
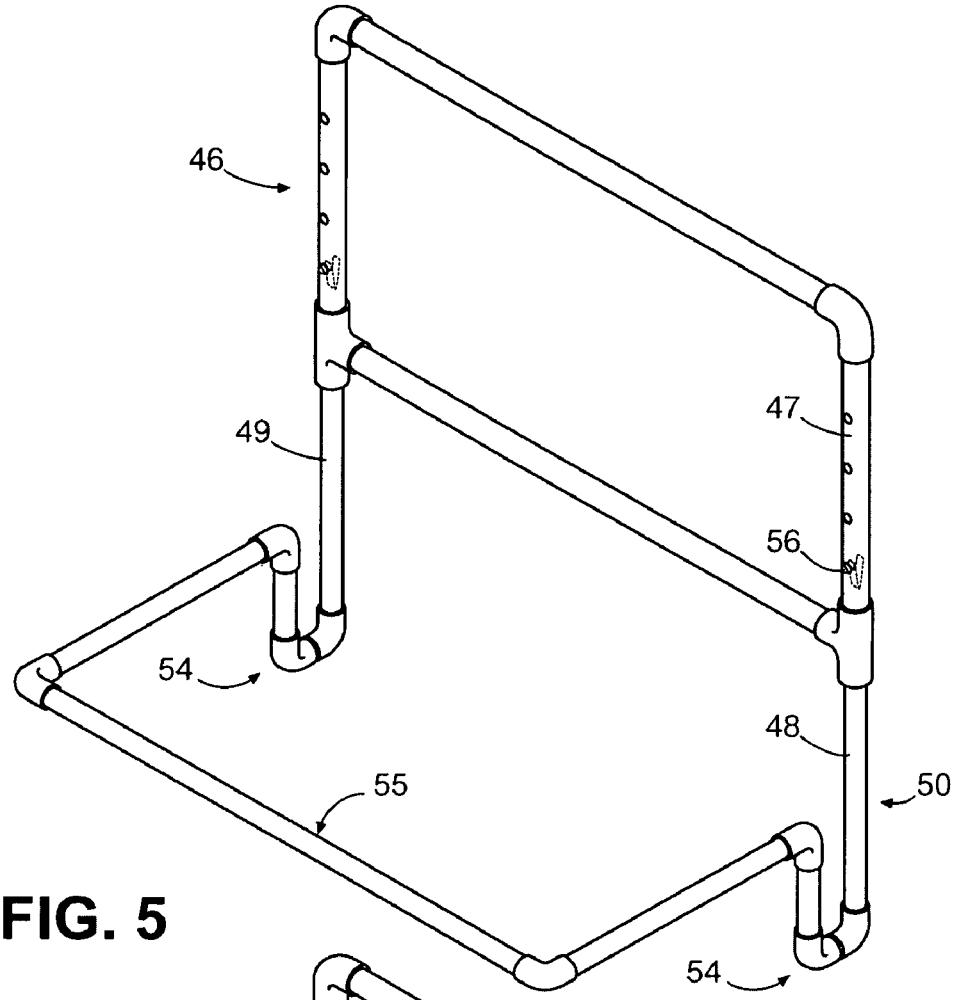
FIG. 5 is a perspective view of another exemplary embodiment of an expandable frame for lifting bed covers, with the frame in its expanded position.
Figure 6:
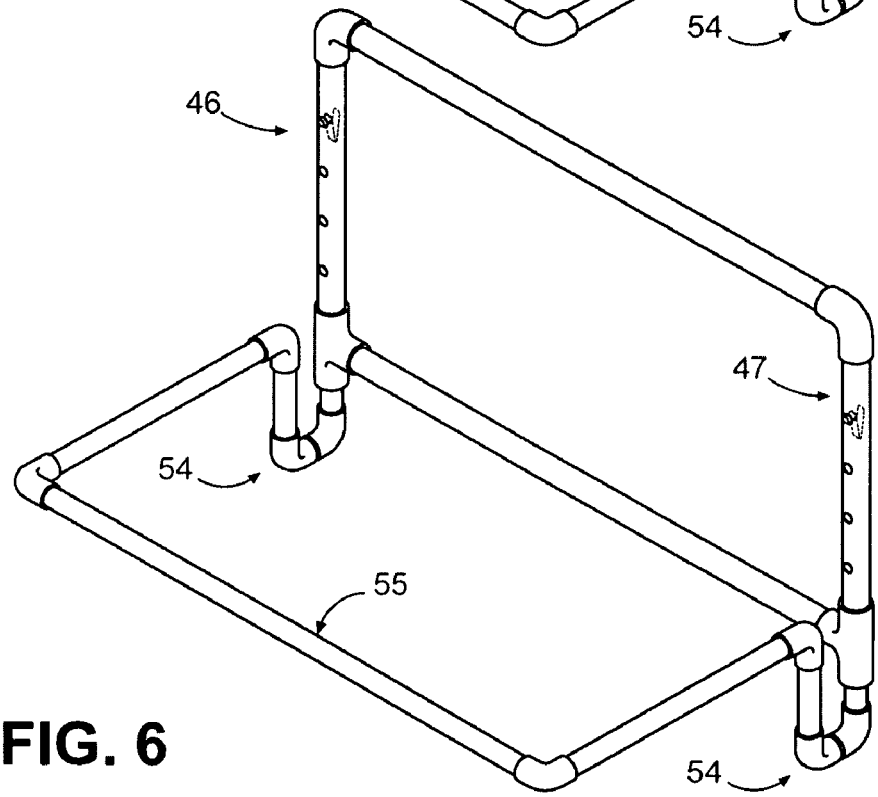
FIG. 6 is a perspective view of the expandable frame of FIG. 5, but showing the frame in its contracted position.

FIGS. 5 and 6 show another embodiment 46 of the expandable frame. The upper movable support frame segment 47 is substantially identical to that of the movable support frame segment 17 of FIGS. 1, 2 and 4. The upper movable support frame segment 47 is movable telescopically down about the upright bars 48 and 49 of the vertical support frame segment 50. The bars 48 and 49 may be longer than the bars 30 and 31 of FIGS. 1 and 2, providing a longer length of telescopic movement of the upper movable support frame segment 47. This allows the movable support frame segment to extend upwardly farther than the movable support frame segment 17 of FIGS. 1 and 2 and to move down farther down to a position below the level of the covers of the bed. A U-shaped lower support arrangement 54 is formed at the lower ends of the bars 48 and 49, so that the lateral support frame segment 55 is located at the proper height for insertion between the box springs and the mattress. Lock buttons 56 may be used to maintain the upper movable segment in place.

Figure 7:
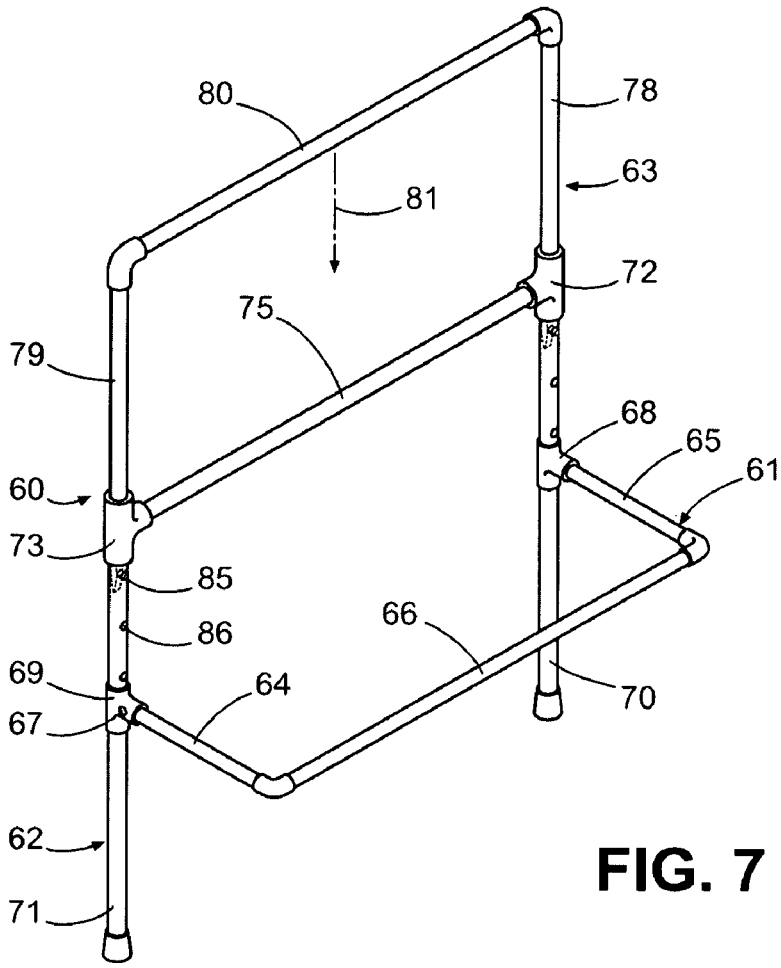
FIGS. 7 and 8 are perspective views of another exemplary embodiment of an expandable frame, showing the expandable frame in its expanded configuration and in its contracted configuration, respectively.
Figure 8:
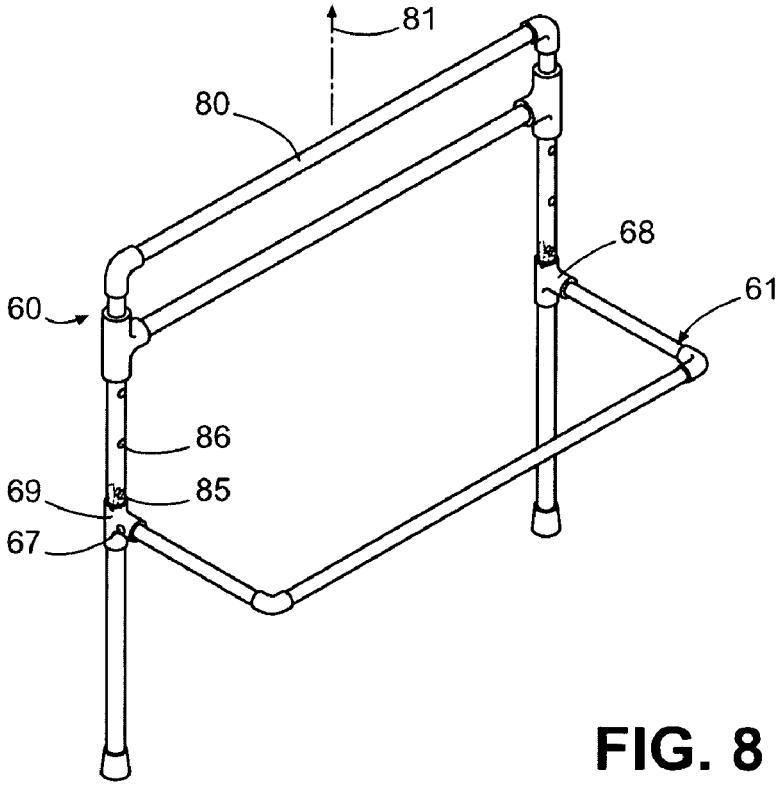

FIGS. 7 and 8 show another embodiment of the expandable frame. The expandable frame 60 includes a lateral support frame segment 61, a vertical support frame segment 62, and a movable frame segment 63. The lateral support frame segment 61 is U-shaped, with end bars 64 and 65 and stabilizing bar 66, with the stabilizing bar 66 connected at its ends by corner connectors to the end bars 64 and 65, forming a U-shape. The other ends of the end bars 64 and 65 are each connected to the stem of a T-shaped connector 68 and 69.

The vertical segment support frame 62 comprises a pair of upright bars 70 and 71 that extend through the head openings of the T-shaped connectors 68 and 69, respectively, with the upper end portions of the upright bars 70 and 71 received in T-shaped connectors 72 and 73, respectively. A horizontal stabilizing bar 75 extends between the T-shaped connectors 72 and 73, as shown.

The movable vertical support frame segment 63 is an inverted U-shape and includes opposed upright telescope bars 78 and 79, and horizontal support bar 80. The support bar 80 is connected at its ends by elbow connectors to the upper ends of the opposed upright telescope bars 78 and 79.

The opposed upright telescope bars 78 and 79 are of smaller outside diameter than the inside diameter of the T-shaped connectors 68, 69 and 72, 73 and are of smaller outside diameter than the upper end portions of the upright bars 70 and 71 or the vertical support frame segment 62. This enables the movable vertical support frame segment 63 to move telescopically up and down with respect to the vertical support frame segment 62, for substantially the full length of the upright bars 70 and 71.

As shown in FIGS. 7 and 8, when the movable vertical support frame segment 63 is moved downward in the direction as indicated by arrow 81, it can move to the position as shown in FIG. 8. Likewise, when the movable vertical support frame segment 63 is moved upwardly as shown in the direction of arrow 82, it changes configuration from that shown in FIG. 8 to that shown in FIG. 7.

When in use, the expandable frame 60 is placed at the foot of a conventional bed having a box spring assembly and a mattress, by inserting the lateral support frame segment 61 between the box springs and the mattress, leaving the vertical support frame segment 62 and the movable frame segment 63 in vertical orientation juxtaposed the outside surface of the foot of the bed. The vertical dimension of the expandable frame 60 from the T connectors 68 and 69 up to the position of the horizontal support bar 80 when in its contracted position as shown in FIG. 8 is configured so that the horizontal support bar 80 will be at or slightly below the plane of the top surface of the mattress. With this shape, the bed covers of the bed can be draped over the horizontal support bar 80 without significant visual obstruction.

When it is desired to support the bed covers at the foot of the bed higher than the surface of the bed to accommodate the feet of the sleeper, as generally shown in FIG. 1, a person will lift the horizontal support bar 80 of FIGS. 7 and 8 in the upward direction as indicated by arrow 81 until the horizontal support bar reaches the position shown in FIG. 7. Lock buttons, such as lock button 85 of FIGS. 7 and 8, are carried by the opposed upright telescope bars 78 and 79, and the lock buttons will register with one of the lock button openings 86, locking the movable vertical support frame segment 63 in the position as shown in FIG. 7.

Lateral support frame segment 61 is releasably connected to the T connectors 68 and 69. The releasable connection can be formed by a lock button or threaded bolt or other conventional connector 67 through the stems of the T-shaped connectors 68 and 69, and through the inner ends of the end bars 64 and 65. With this arrangement, the lateral support segment 61 may be detached from the rest of the expandable frame 60 and the elements of the expandable frame 60 can be laid flat in a shipping container.

Figure 9:
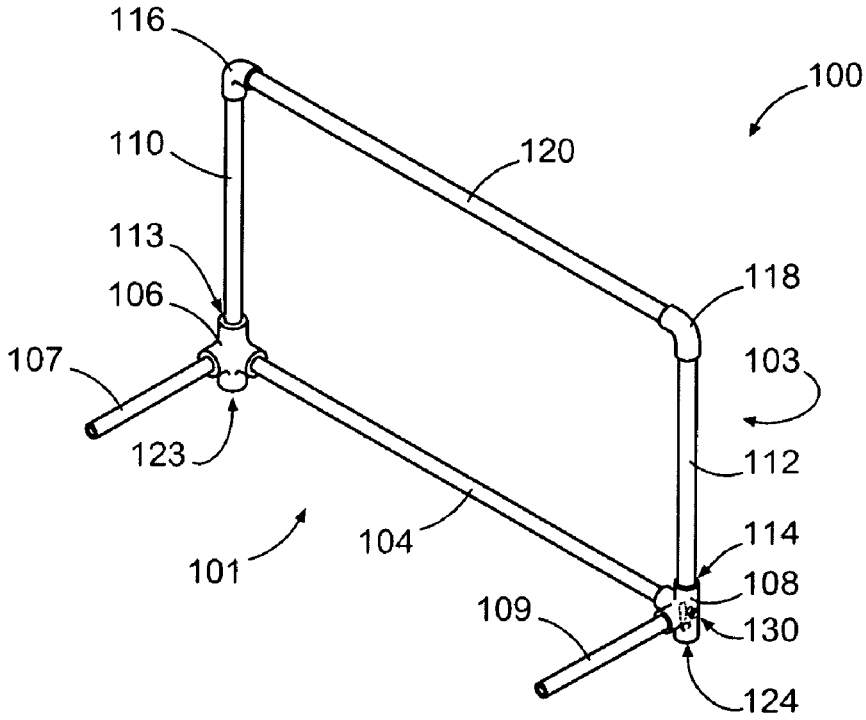
FIGS. 9 and 10 are perspective views of another exemplary embodiment of an expandable frame, showing the expandable frame in its expanded configuration and in its contracted configuration, respectively.
Figure 10:
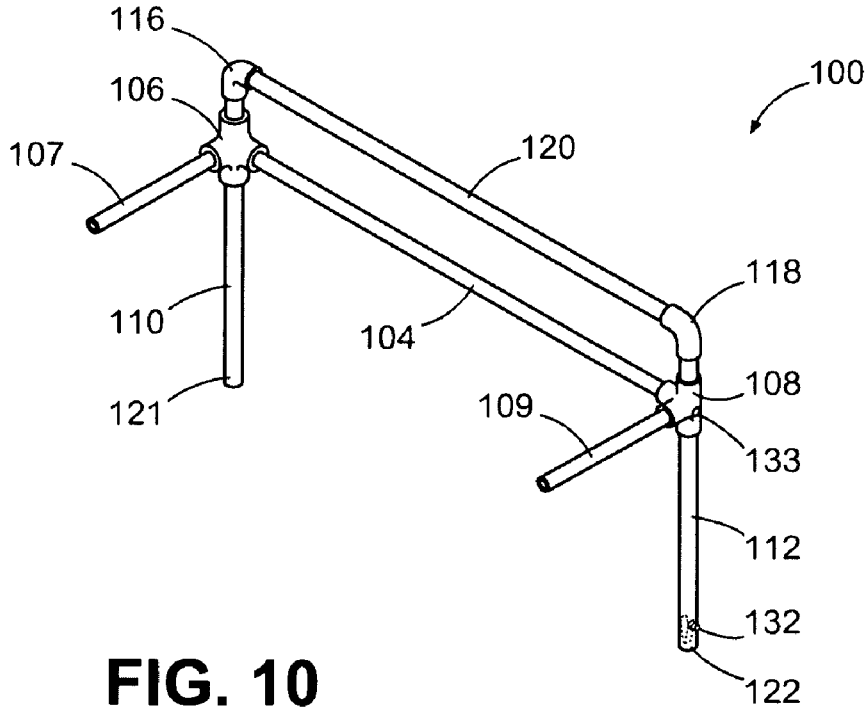

FIGS. 9 and 10 show another embodiment of the expandable frame. The expandable frame 100 includes a support frame segment 101 and a movable frame segment 103. The support frame segment 101 is U-shaped, with a stabilizing, lower cross bar 104. The lower cross 104 is connected at its ends by corner (4-way) connectors 106, 108. Legs 107, 109 extend outwardly from and substantially perpendicular to the lower cross bar 104 to form a U-shape.

The movable frame segment 103 comprises a pair of upright bars (uprights) 110, 112 that extend through the head openings 113, 114, respectively, of the connectors 106, 108. Upper end portions of the uprights 110, 112 are received by connectors 116, 118, respectively, which are elbow joints in this embodiment. Other ends of the connectors 116, 118 receive opposing ends of an upper cross bar 120.

The movable frame segment 103 forms a U-shape, which is inverted in operation. Distal ends 121, 122 of the movable frame segment lock within the connectors 106, 108 in the expanded position shown in FIG. 9. A locking mechanism (e.g., locking mechanism 130) selectively locks the first upright and the second upright in the expanded position. In this embodiment, the locking mechanism 130 comprises a lock button 132 carried by the upright 112 and a hole 133 (e.g., a drilled hole) positioned in the connector 108. In the expanded position, the lock button 132 is received within the hole 133. To facilitate movement to the contracted position, the lock button is released from the hole. In other embodiments, a locking mechanism could be included on each of the uprights.

As shown in FIG. 10, the contracted position involves the uprights being telescopically received by the connectors, thereby positioning the upper cross bar closer to the lower cross bar. In this embodiment, distal ends of the uprights extend through the lower openings 123, 124 of the connectors 106, 108. Notably, the uprights are substantially longer than the corresponding lengths of the connectors 106, 108 through which the uprights extend. In some embodiments, such as those in which conventional PVC connectors are used, modifications to off-the-shelf components may be required. By way of example, connectors oftentimes include internal flanges for positioning the ends of tubes received by the connectors. For the purpose of creating a connector through which a tube is to pass without restriction (e.g., connector 106), the internal flange may need to be altered, such as by drilling out the material that forms the flange.

Although various materials can be used to form an expandable frame, PVC tubing may be preferred in some embodiments. As such, a representative embodiment formed of PVC tubing can include a movable frame segment consisting of three lengths of tubing and two connectors, and a support frame segment consisting of three lengths of tubing and two connectors. Other configurations can be used as well.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. By way of example, although various embodiments are depicted that involve the use of two uprights, other embodiments (such as those that are wider, or otherwise require increased support) can use different numbers of uprights. All such modifications and variations are intended to be included herein within the scope of this disclosure and protected by the accompanying claims.

The invention claimed is;

1. An expandable frame for lifting bed covers comprising:

a first upright;

a second upright;

an upper cross bar;

a lower cross bar oriented substantially parallel with respect to the upper cross bar;

a first connector having a first opening and a second opening, the first opening receiving an upper end of the first upright, the second opening receiving a first end of the upper cross bar;

a second connector having a first opening and a second opening, the first opening of the second connector receiving an upper end of the second upright, the second opening of the second connector receiving a second end of the upper cross bar;

a first leg;

a second leg;

a third connector having a first opening, a second opening, a third opening and a fourth opening, the first opening of the third connector receiving a lower end of the first upright, the second opening of the third connector receiving a first end of the lower cross bar, and the third opening of the third connector receiving an attached end of the first leg such that a free end of the first leg extends outwardly from the third connector;

a fourth connector having a first opening, a second opening, a third opening and a fourth opening, the first opening of the fourth connector receiving a lower end of the second upright, the second opening of the fourth connector receiving a second end of the lower cross bar, and the third opening of the fourth connector receiving an attached end of the second leg such that a free end of the second leg extends outwardly from the fourth connector;

the first upright being movable with respect to the third connector and the second upright being movable with respect to the fourth connector such that, in a contracted position, the upper cross bar is spaced from the lower cross bar at a first distance and, in an expanded position, the upper cross bar is positioned farther than the first distance from the lower cross bar to lift bed covers draped over the upper cross bar away from the lower cross bar; and a locking mechanism operative to selectively lock the expandable frame in the expanded position;

wherein:

each of the first upright, second upright, upper cross bar, lower cross bar, first foot and second foot is elongate and hollow; and in the contracted position:

the first upright extends through the third connector via the first and fourth openings of the third connector, with the first upright being substantially longer than a corresponding length of the third connector through which the first upright extends; and the second upright extends through the fourth connector via the first and fourth openings of the fourth connector, with the second upright being substantially longer than a corresponding length of the fourth connector through which the second upright extends.

2. The frame of claim 1, wherein:

the locking mechanism comprises a lock button carried by the first upright and a hole positioned in the third connector;

in the expanded position, the lock button is received within the hole and, to facilitate movement to the contracted position, the lock button is released from the hole.

3. The frame of claim 1, wherein each of the first upright, second upright, upper cross bar, lower cross bar, first foot and second foot is formed of PVC tubing.

4. The frame of claim 1, wherein each of the third and fourth connectors is a four-way connector.

5. The frame of claim 1, wherein each of the first and second connectors is an elbow joint.

* * * * *